US005322414A

United States Patent [19]

Newman

[11] Patent Number: 5,322,414

[45] Date of Patent: Jun. 21, 1994

[54] ENTERTAINMENT FAN

[75] Inventor: Howard Newman, Homewood, Ill.

[73] Assignee: Ken Howard Industries, Inc., Homewood, Ill.

[21] Appl. No.: 50,897

[22] Filed: Apr. 21, 1993

Related U.S. Application Data

[63] Continuation-in-part of Ser. No. 361, Oct. 31, 1992.

[51] Int. Cl.[5] ..... A45B 27/02

[52] U.S. Cl. ..... 416/73; D3/2

[58] Field of Search ..... 416/69, 70 R, 72, 73; D3/1, 2

[56] References Cited

U.S. PATENT DOCUMENTS

| | | | |
|---|---|---|---|
| 107,501 | 9/1870 | Ireland . | |
| 163,266 | 5/1875 | Schwartz . | |
| 257,058 | 4/1882 | North . | |
| 357,072 | 2/1887 | Elefsen . | |
| 492,684 | 2/1893 | Irving . | |
| 519,554 | 5/1894 | Rubin | 416/73 |
| 915,663 | 3/1909 | D'Aversa . | |
| 1,963,558 | 6/1934 | Pesmen . | |
| 2,137,671 | 11/1938 | Harding . | |
| 2,542,199 | 2/1951 | Keene et al. . | |
| 4,564,538 | 1/1986 | Scholtz . | |

FOREIGN PATENT DOCUMENTS

| | | | |
|---|---|---|---|
| 0094162 | of 0000 | Fed. Rep. of Germany | 416/73 |
| 0332792 | of 0000 | France | 416/69 |
| 0521188 | 3/1955 | Italy | 416/73 |

*Primary Examiner*—Edward K. Look
*Assistant Examiner*—Mark Sgantzos
*Attorney, Agent, or Firm*—Wallenstein, Wagner & Hattis, Ltd.

[57] ABSTRACT

A fan (10) is disclosed that includes a first leg (20) and an interconnected second leg (30), the legs (20,30) being movable relative to each other between a first, closed position and a second, open position. A blade (41) is secured to and disposed between the two legs (20,30) generally adjacent the top (13) of the fan (10). A torsion spring (50) having a coil (51) and two projecting arms (52), with each arm (52) abutting one leg (20,30) is adapted for biasing the legs (20,30) to the open position. A release mechanism (54) adapted for releasably locking the legs (20,30) in the closed position has a post (55) attached to and projecting from the second leg (30) and a barb (56,56*a*,56*b*) at the distal end thereof adapted for cooperating with an aperture (57) in the first leg (20) when the legs are in the closed position.

14 Claims, 3 Drawing Sheets

FIG. 4
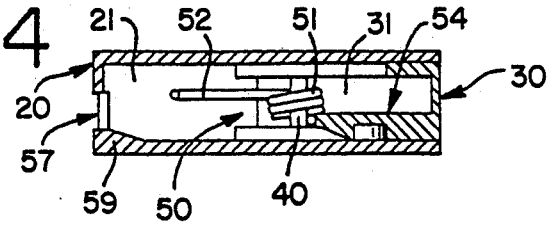
FIG. 5
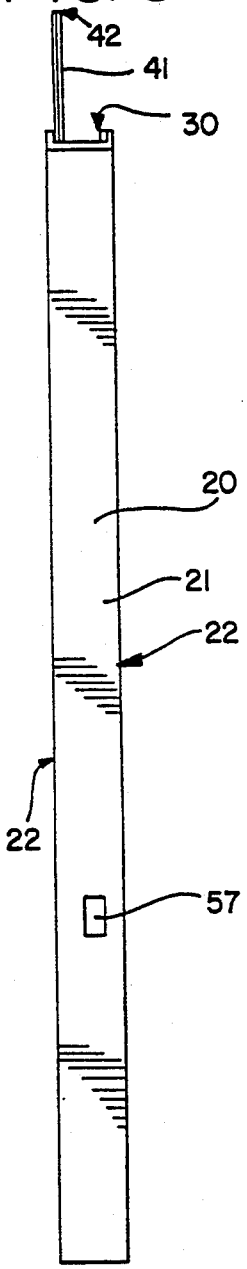
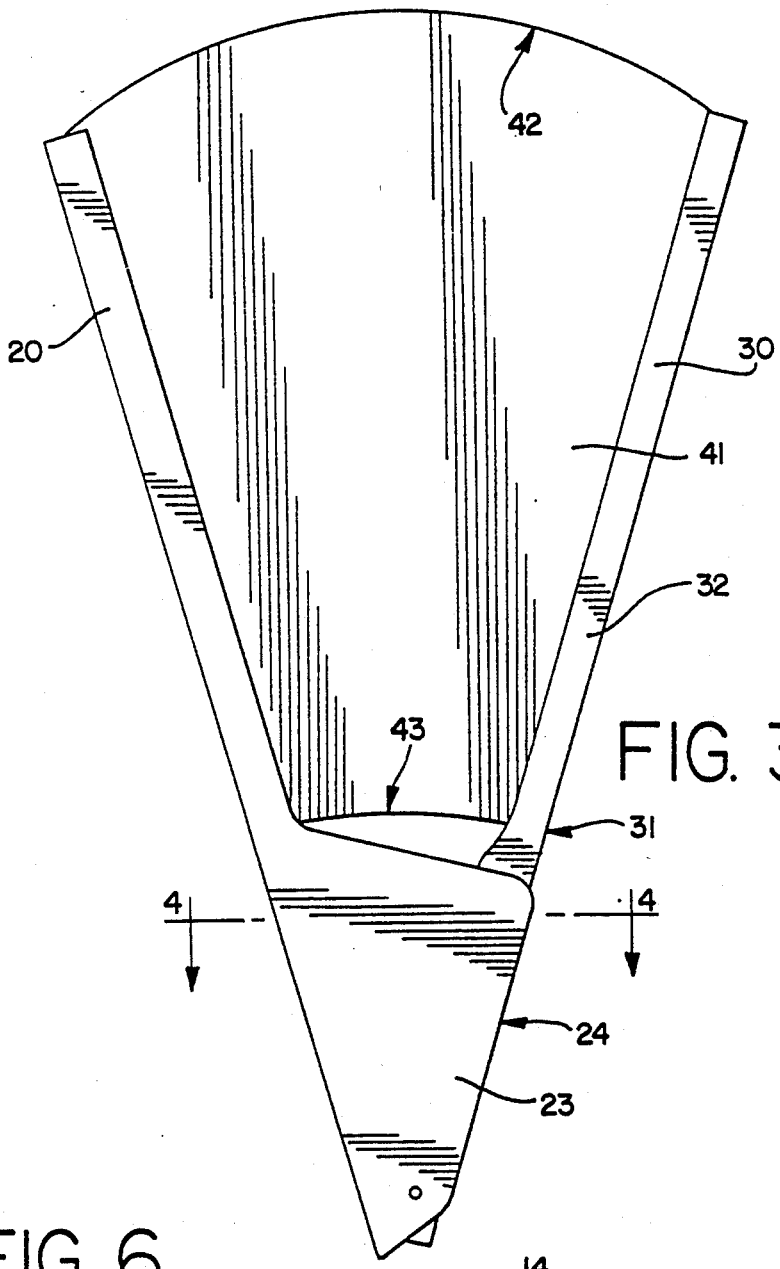
FIG. 3
FIG. 6
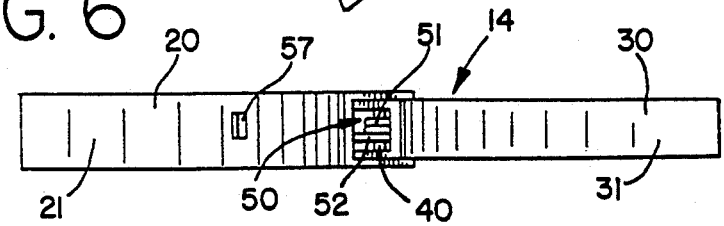

ENTERTAINMENT FAN

REFERENCE TO RELATED APPLICATIONS

This application is a continuation-in-part application of a copending application, U.S. Ser. No. 29/000,361, filed 13 Oct. 1992.

TECHNICAL FIELD

The present invention relates generally to fans, and more particularly, to a snapping fan for entertainment.

BACKGROUND PRIOR ART

Hand held fans have been used for hundreds of years both as an art medium and as means for cooling an individual. As such, fans take on many forms and shapes. In fact, to date, some fans have even included mechanical parts to aid either in the opening and the closing of the fan or in the waving of the fan.

However, there seems to be very little, if any, exploitation of hand held fans for advertisement and entertainment. As a result, there is a need for a fan that is attractive, useful and capable of supporting advertising, such as a slogan, logo or mark. In addition, there is a need for a fan that can also be used for entertainment, i.e., one that makes noise when opened, closed or used.

SUMMARY OF THE INVENTION

The present invention is such a hand held fan that is attractive and entertaining and can be used as a medium for advertising.

According to a primary aspect of the present invention, the fan includes a first leg having a top and a bottom with an integral grip portion adjacent the bottom and a second leg also having a top and a bottom interconnected to the first leg adjacent both of the bottoms of the legs. The second leg is nested within the grip portion and movable within the grip portion between a first, closed position when the two legs are adjacent one another, and a second, open position when the two legs are spaced from one another. A blade is secured to and disposed between the first leg and the second leg and is adapted to restrain further movement of the second leg away from the first leg. Means for biasing the legs to the second, open position, as well as means for releasably locking the second leg in the first, closed position, are further provided within and are generally covered by the grip. This grip portion acts as a guard to protect both the user and the mechanics of the fan.

According to another aspect of the present invention, the first leg and the second leg of the fan are each U-shaped channel members having an end wall and two projecting side walls. The grip portion is an extension of the side walls of the first leg. According to an additional aspect of the present invention, the legs are interconnected by a pivot pin and the biasing means is a torsion spring having a coil disposed around the pivot pin and two projecting arms, each arm abutting one of the legs.

According to yet another aspect of the present invention, the locking means is a release mechanism attached to the second leg for cooperating with the first leg when the legs are in the first, closed position. The release mechanism comprises a post attached to and projecting from the second leg and a barb at the distal end of the post adapted for cooperating with a ramp on the side wall and an aperture in the end wall of the first leg.

Advertising can be placed on the blade by many conventional means. Thus, by holding the grip portion of the fan in one hand, one can open it by moving the barb with the thumb and, close the fan, by moving the second leg towards the first leg with the index figure. This can be repeated many times. And, with a strong, heavy-duty spring, the fan will snap open with a loud "crack."

Other advantages and aspects of the present invention will become apparent upon reading the following description of the drawings and the detailed description of the invention.

BRIEF DESCRIPTION OF DRAWINGS

In order that the present invention may be understood, it will now be described by way of example, with reference to the accompanying drawings in which:

FIG. 3 is a front elevation view thereof;

FIG. 4 is a sectional view taken along line 4—4 of FIG. 3;

FIG. 5 is a left side elevation view thereof;

FIG. 6 is a bottom plan view thereof;

DETAILED DESCRIPTION

Figure 1:
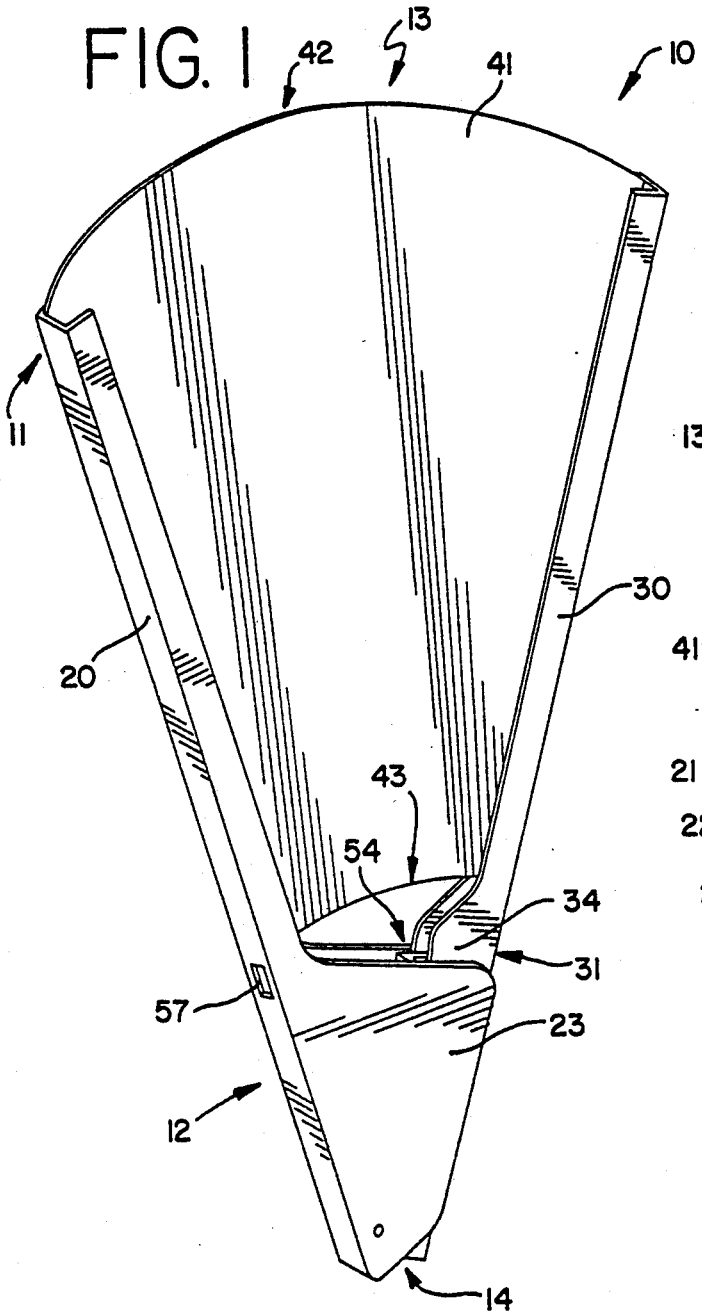
FIG. 1 is a perspective view of the fan made in accordance with the teachings of the present invention in the open position.
Figure 2:
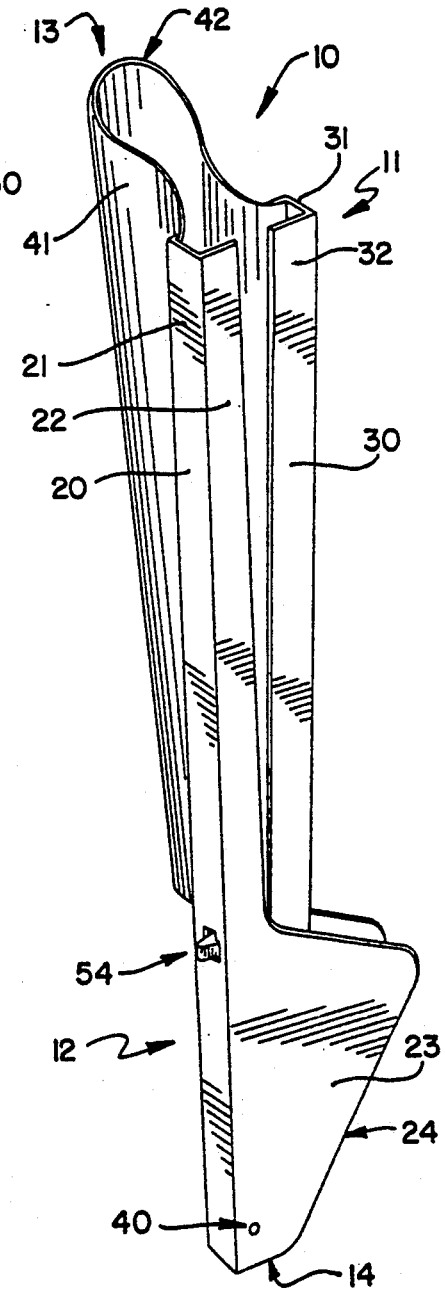
FIG. 2 is a perspective view thereof in the closed position.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

The fan of the present invention, identified generally by reference number 10, is shown in FIGS. 1–9. The fan 10 has an upper portion 11 generally adjacent the top 13 of the fan and a base portion 12 generally adjacent the bottom 14 of the fan.

The fan 10 includes a first leg 20 and a second leg 30 that are interconnected near the bottom 14 in the base portion 12 by a pivot pin 40. The pivot pin 40 is preferably threaded within and between an aperture in each of the two legs 20,30. With this arrangement, the first leg 20 and the second leg 30 are movable relative to each other between a first, closed position (FIG. 2) and a second, open position (FIGS. 1 and 3).

A blade 41 is secured to and disposed between the first leg 20 and the second leg 30 generally adjacent the top 13 of the fan 10. Preferably, the top of the blade 41 has an outwardly curving, or arcuate, leading edge 42; the bottom of the blade 41 also has an inwardly curving, or arcuate, trailing edge 43. The blade 41 can be attached to the legs 20,30 by conventional means, such as glue.

The first leg 20 is a U-shaped channel member having a end wall 21 and two projecting side walls 22. Similarly, the second leg is also a U-shaped channel member having a end wall 31 and two projecting side walls 32. A grip 23 is formed at the base portion 12 of the fan 10. This grip 23 is formed by an extension of the two side walls 22 of the first leg 20. In essence, this grip 23 serves as a first guard to protect one from contacting the internal components of the fan 10. This first guard 23 has an outer edge 24 that extends just beyond the end wall 31 of the second leg 30, when the second leg is in the open position, to again protect the user from contacting moving parts (FIG. 3).

Figure 7:
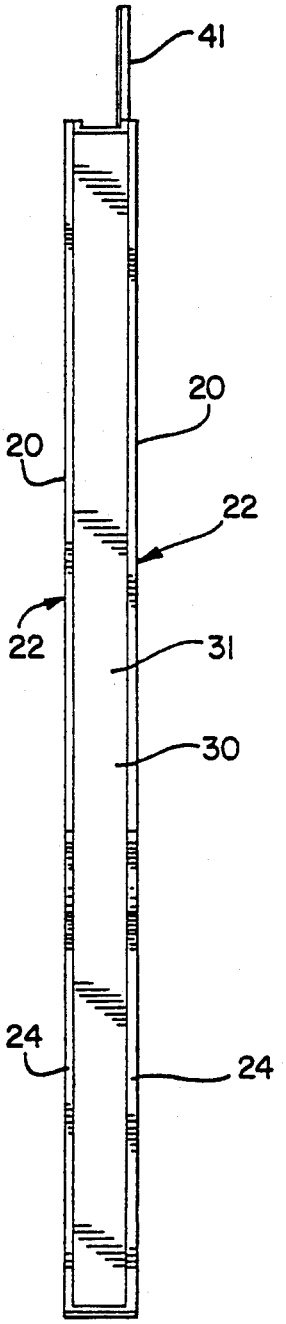
FIG. 7 is a right side elevation view thereof.
Figure 8:
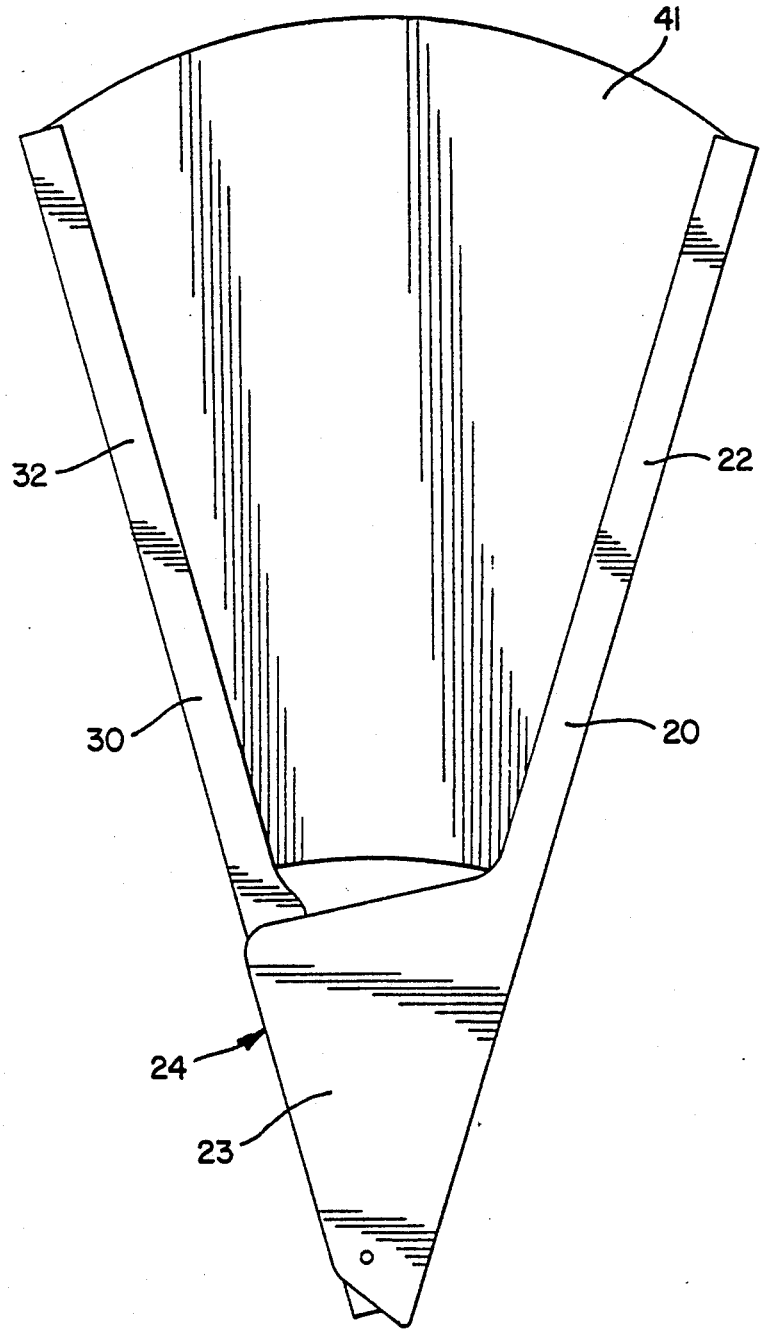
FIG. 8 is a rear elevation view thereof.

Specifically, the second leg 30 is sized so that it nests within the grip 23. This is accomplished by making the width of the end wall 31 of the second leg 30 a little smaller than the width of the end wall 21 of the first leg 20 (FIGS. 5 and 7).

For added structural strength, the two side walls 32 of the second leg 30 have extensions thereon adjacent the bottom 14 of the fan to forte a second guard 34. This second guard 34 nests within the first guard 24.

In order to move the legs 20,30 relative to one another from the closed position to the open position and to hold the fan 10 in the open position, biasing means are provided. In particular, a torsion spring 50 is provided in the base portion 12 of the fan generally adjacent the bottom 14 thereof. The spring 50 has a plurality of windings forming a coil 51 and two arms 52 projecting from each end of the coil. Each spring arm 52 abuts an end wall 21,31 of a leg 20,30 (FIG. 4). Thus, the spring arms 52 push outwardly away from the spring coil 51 against the legs 20,30 forcing the legs apart. Preferably the pivot pin 40 interlocking the two legs 20,30 is disposed within and transverses the coil 51 of the spring 50. In this manner, the spring 50 is held within the grip 23 of the fan and will not inadvertently pop out.

It should be noted that in actuality, it is the second leg 30 that moves within the grip 23 between a first, closed position when the legs are adjacent one another and a second, open position when said legs are spaced from one another.

Figure 9:
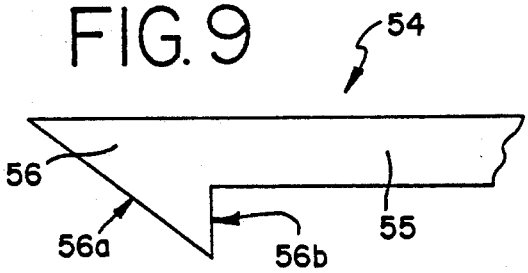
FIG. 9 is a top plan view of the post and the barb.

Means are further provided for releasably locking the legs 20,30 in the first, closed position. In particular, within the grip 23 of the base portion 12 of the fan 10, there is a release mechanism 54 adapted for releasably locking the second leg 30 adjacent the first leg 20, thereby retaining and holding the fan and legs in the first, closed position. The release mechanism 54 has a post 55 attached to and projecting from the second leg 30. At the distal end of the post 55, a head or barb 56 is provided for cooperating with an aperture 57 in said end wall 21 of the first leg 20 when the legs are in the first, closed position. As shown in FIG. 9, the barb 56 has an inclined outer surface **56*a* and a substantially perpendicular inner surface 56*b*. This arrangement permits the barb 56 to easily slide into the aperture 57 as the inclined outer surface 56*a* abuts the wall of the aperture. During this movement, the post 55, deflects a small amount in a direction away from the side of the post 55 having the inner surface 56*b*. Once the barb 56 is entirely through the aperture 57 and the perpendicular inner surface 56*b* clears the outermost portion of the end wall 21, the post 55 again deflects, but in the opposite direction, towards the side of the post 55 having the inner surface. This causes the barb 55, and more particularly the inner surface 56*b*, to lock onto the end wall 21 of the first leg 20. To aid the barb's movement towards the aperture 57, a ramp 59 is provided on the inner surface of the grip (23) adjacent the aperture (FIG. 3**).

One must apply pressure to the legs 20,30 during this procedure of moving the legs from the open position to the closed position, because the spring 50 is forcing the legs apart. Consequently, locking is almost automatic since just prior to the barb's clearing the aperture 57, the post 55 is in a state of deflection and the moving legs 20,30 are compressing the arms 52 of the spring 50. Once the barb 55 clears the aperture, the barb immediately moves into and grips the end wall 21.

To open the fan 10, one needs only to move the barb 55 with his or her thumb in a direction away from the side of the post having the perpendicular inner surface **56*b*. Thus, by holding the grip 23 of the fan 10 in one hand, one can open the fan by moving the barb 55 with the thumb, and close the fan by moving the second leg 30 towards the first leg 20** with the index figure. This can be repeated many times.

In practice, it has been found, that if a strong, heavy-duty spring is used, the fan will "snap" open with a loud "crack" which adds to its entertainment value. In addition, it has been found that a blade 41 of simple paper may not be strong enough to withstand the many openings. Accordingly, a fiber reinforced paper or cloth material may be used for the blade 41. To enhance safety, the first guard or grip 23 is made to generally cover the torsion spring and the release mechanism 54.

While a specific embodiment has been illustrated and described, numerous modifications come to mind without significantly departing from the spirit of the invention and the scope of protection is only limited by the scope of the accompanying claims.

I claim:

1. A fan comprising:

a first leg and an interconnected second leg, said legs movable relative to each other between a first, closed position and a second, open position;

a blade secured to and disposed between said first leg and said second leg generally adjacent the top of the fan;

means for biasing said legs to said second, open position generally adjacent the bottom of the fan; and, means for releasably locking said legs in said first, closed position, said first leg having a first guard generally covering said biasing means and said locking means.

2. The fan as defined in claim 1, wherein said first leg is a U-shaped channel member having an end wall and two projecting side walls, said first guard being an extensin of said side walls.

3. The fan as defined in claim 2, wherein said biasing means is a torsion spring having a coil and two projecting arms, each said arm abutting one said leg.

4. The fan as defined in claim 2, wherein said second leg is a U-shaped channel member having an end wall and two projection side walls, said two side walls having extensions thereon forming a second guard, said second guard nesting within said first guard.

5. The fan as defined in claim 3, wherein said locking means is a release mechanism attached to said second leg for cooperating with said first leg when said legs are in said first, closed position.

6. The fan as defined in claim 5, wherein said release mechanism is a post attached to and projecting from said second leg and having a barb at the distal end for sliding into an aperture in said end wall of said first leg.

7. A fan comprising:

a fist leg and an interconnected second leg, said legs movable relative to each other between a first, closed position and a second, open position, said first leg being a U-shaped channel member having an end wall and two projecting side walls, said two side walls having extensions thereon adjacent the bottom of the fan forming a first guard, said second leg being a U-shaped channel member having an outer end wall and two projection side walls, said two side walls having extensions thereon adjacent the bottom of the fan forming a second guard, said second guard nesting within said first guard;

a blade secured to and disposed between said first leg and said second leg generally adjacent the top of the fan;

a torsion spring located generally adjacent the bottom of the fan having a coil and two projecting arms, each said arm abutting one said end wall for biasing said legs to said , second open position; and, a release mechanism for releasably locking said legs in said first, closed position, said release mechanism having a post attached to and projecting from said second leg and a barb at the distal end for sliding into an aperture in said end wall of said first leg when said legs are in said first, closed position, said guards generally covering said torsion spring and said release mechanism.

8. A fan comprising:

a first leg having a top and a bottom with an integral grip portion adjacent said bottom;

a second leg having a top and a bottom interconnected to said first leg adjacent both said bottoms movable within said grip portion between a first, closed position when said legs are adjacent one another and a second, open position when said legs are spaced from one another;

means for biasing said legs to said second, open position;

a blade disposed between said legs to restrain further movement of said second leg away from said first leg; and means for releasably locking said second leg in said first, closed position.

9. The fan as defined in claims 8, wherein said grip portion generally covers said biasing means, said locking means and a portion of said second leg.

10. The fan as defined in claim 9, wherein said first leg is a U-shaped channel member having an end wall and two projecting side walls, said grip portion being an extension of said side walls.

11. The fan as defined in claim 10, wherein said legs are interconnected by a pivot pin and said biasing means is a torsion spring having a coil around said pivot pin and two projecting arms, each said arm abutting one said leg.

12. The fan as defined in claim 11, wherein said second leg is a U-shaped channel member having an end wall and two projection side walls, said second leg nesting and moving within said grip portion.

13. The fan as defined in claim 12, wherein said locking means is a release mechanism attached to said second leg for cooperating with said first leg when said legs are in said first, closed position.

14. The fan as defined in claim 13, wherein said release mechanism is a post attached to and projecting from said second leg and having a barb at the distal end for sliding into an aperture in said end wall of said first leg.

* * * * *